United States Patent [19]

Cordier

[11] 4,269,112

[45] May 26, 1981

[54] ENCLOSURES FOR THE TREATMENT OF WORKPIECES

[75] Inventor: André G. Cordier, Montrouge, France

[73] Assignee: Air Industrie, Courbevoie, France

[21] Appl. No.: 85,422

[22] Filed: Oct. 16, 1979

[30] Foreign Application Priority Data

Nov. 15, 1978 [FR] France ..... 78 32300

[51] Int. Cl.[3] ..... B05C 15/00

[52] U.S. Cl. ..... 98/115 SB; 55/DIG. 46; 98/36

[58] Field of Search ..... 98/36, 115 R, 115 SB, 98/DIG. 46; 55/385 A, DIG. 29; 118/326, 634, DIG. 7; 239/548

[56] References Cited

U.S. PATENT DOCUMENTS

| | | | |
|---|---|---|---|
| 3,145,427 | 8/1964 | Reiterer | 239/548 X |
| 3,807,291 | 4/1974 | Roberts et al. | 98/115 SB |
| 4,048,912 | 9/1977 | Walker | 98/115 SB |

*Primary Examiner*—Albert J. Makay
*Assistant Examiner*—Harold Joyce
*Attorney, Agent, or Firm*—Larson and Taylor

[57] ABSTRACT

The invention relates to a ventilated enclosure for the treatment of workpieces, particularly an elongated enclosure for painting workpieces, comprising a treatment space situated between a ceiling through which the supply of new air takes place and a floor, said ceiling comprising, particularly from upstream to downstream following the path of the air, a filter and a diffuser, said enclosure being furthermore equipped with air injectors. These injectors are arranged and disposed so as to deliver jets or sheets of air in one or more free spaces situated in the ceiling between the filter and the diffuser.

12 Claims, 4 Drawing Figures

ENCLOSURES FOR THE TREATMENT OF WORKPIECES

The invention relates to enclosures for the treatment of workpieces, particularly elongated enclosures (in tunnel form) for painting workpieces (such as car bodies) in the motor industry.

It is known that such enclosures are ventilated and that for this purpose they comprise a treatment space situated between a ceiling through which the feeding in of new air takes place and a floor through which the discharge of the polluted air generally takes place.

This ceiling comprises in general, from up stream to downstream following the path of the air, new air supply means, filtering means and diffusion means.

The supply means may be formed by ducts and/or fans and may be completed by air-conditioning means for giving to the new air a temperature and humidity suitable for the treatment contemplated.

The filtering means may be formed by one or more filters with filtering medium or by one or more sleeve filters.

The diffusion means may be formed by a grid, a coarse medium, a slat or honeycomb assembly: in any case, the diffusion means have greater permeability (and even markedly greater) than the permeability of the filtering means, which means that these diffusion means provide no complementary filtering since situated downstream of the filtering means.

As for the floor, it may comprise, from upstream to downstream following the path of the air, separating means for separating the solid and/or liquid particles contained in the polluted discharged air and means for extraction of the polluted air.

This being so, it should be pointed out that in a treatment enclosure, the efficiency of the ventilation does not always have to be the same depending on the positions in the enclosure. A ventilation may, in fact, be desired giving higher air circulation speeds in positions where solid and/or liquid particles are released, or even a ventilation creating air curtains between two positions so as to isolate them from one another.

Thus it is that treatment enclosures have been proposed with variable air-speed ventilation; such enclosures comprise injection means arranged to deliver, in the air flow generated by the supply means, a plurality of jets or sheets of air, at a speed higher than that of said flow.

Such treatment enclosures are known but present two series of disadvantages due to the presence of the injection means.

In fact, up to the present time, the injection means were disposed in the upper part of the treatment space so as to be able to deliver efficient jets or sheets of air, particularly for increasing locally the flow speeds of the air or for creating air curtains.

Now, such a solution presents a first disadvantage due to the disturbance generated by the air jets or sheets which may cause swirls resulting in the formation of dead zones in the treatment space and this in the vicinity of the workpieces to be treated, a second disadvantage due to the impossibility of acting on the jets or sheets of air once they have been delivered by the injection means, e.g. for deflecting and orientating these jets or sheets of air towards preferential zones of the treatment space, and a third disadvantage due to the inconvenience which these injection means present in the upper part of the treatment space (limitation of the movements of the devices providing the treatment, risk of clogging up of these injection means by the products ensuring the treatment, disturbances of the normal air flow in the treatment enclosure).

The invention has as its aim to remedy these three disadvantages.

The invention relates to a treatment enclosure of the kind defined above and equipped with injection means, these injection means not disturbing the flow from the supply means by the jets or sheets of air which they deliver.

The invention also relates to a treatment enclosure of the kind defined above and equipped with injection means, these injection means causing no interference (neither limitation of the movements of the devices ensuring the treatment, nor risk of clogging up by the products ensuring the treatment, nor disturbances of normal air flow in the treatment enclosure).

According to the invention, the ventilated treatment enclosure comprises a treatment space situated between a ceiling through which the supply of new air takes place and a floor, said ceiling comprising, from upstream to downstream following the path of the air, new air supply means, filtering means and diffusion means, and said enclosure, equipped with injection means, is characterized by the fact that these injection means are arranged and disposed so as to deliver jets or sheets of air in one or more free spaces situated in the ceiling between the filtering means and the diffusion means.

With this arrangement, the disturbing effects of the jets or sheets of air from said injection means on the flow generated by the supply means are diminished, even eliminated, by the diffusion means, and it is possible to act on the jets or sheets of air delivered by the injection means by arranging the diffusion means so that they may provide locally at least a deflection effect, and the treatment space remains entirely free, which eliminates the interference to which the devices ensuring the treatment might be subjected, the clogging up of said injection means by products ensuring the treatment, and the disturbances created in the treatment enclosure by the injection means.

The invention consists, apart from the principal arrangement indicated above, of certain other arrangements which are used preferably at the same time and which will be described more explicitly hereafter.

The invention will, in any case, be well understood with the help of the complement of description which follows as well as the accompanying drawings, which complement and drawings are relative to preferred embodiments of the invention and comprise, of course, no limiting character.

FIG. 1, of these drawings, is a schematical view, in cross section, of an elongated enclosure for painting motor bodies constructed in accordance with a first embodiment of the invention.

Figure 1:
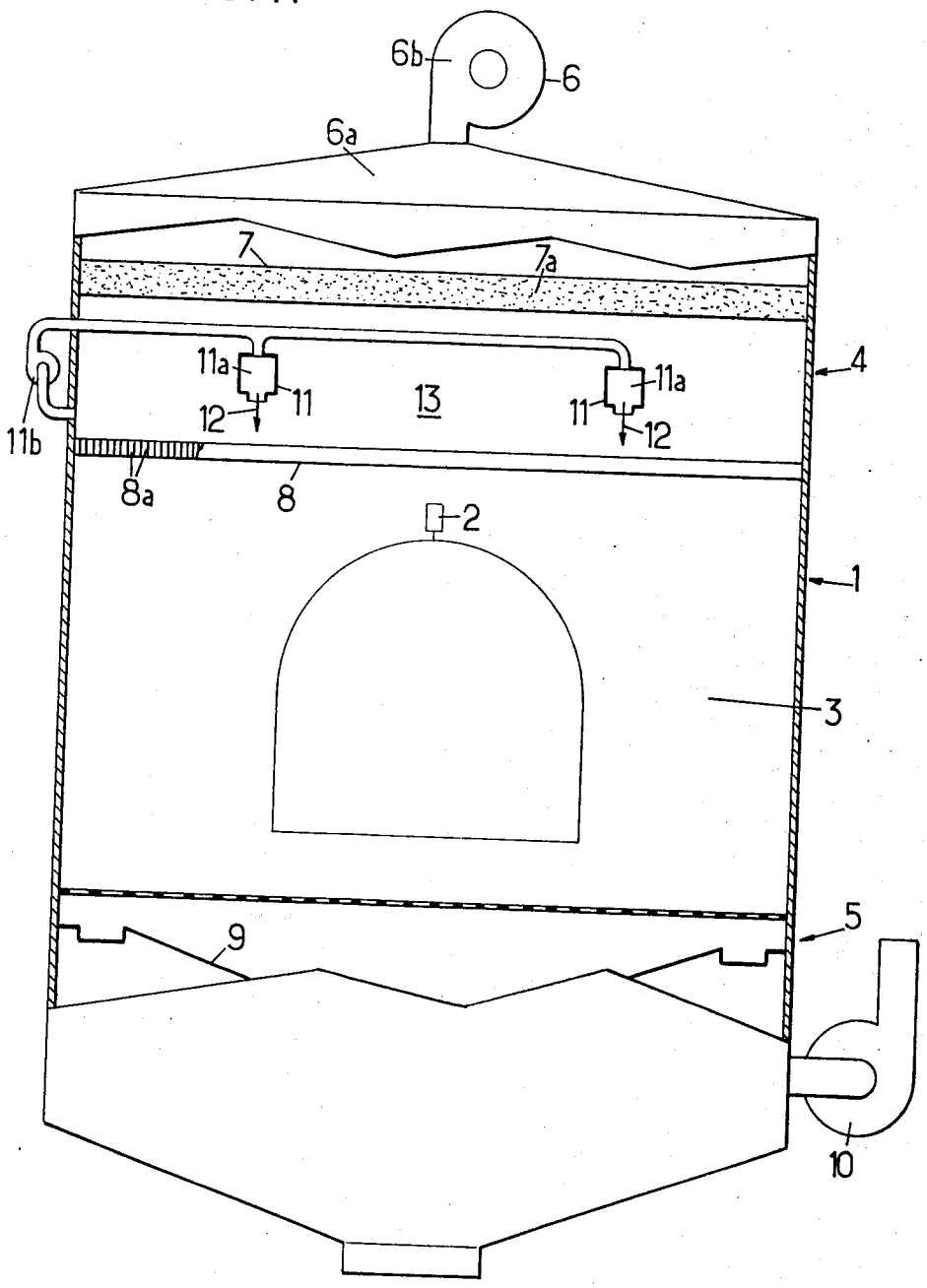
Figure 2:
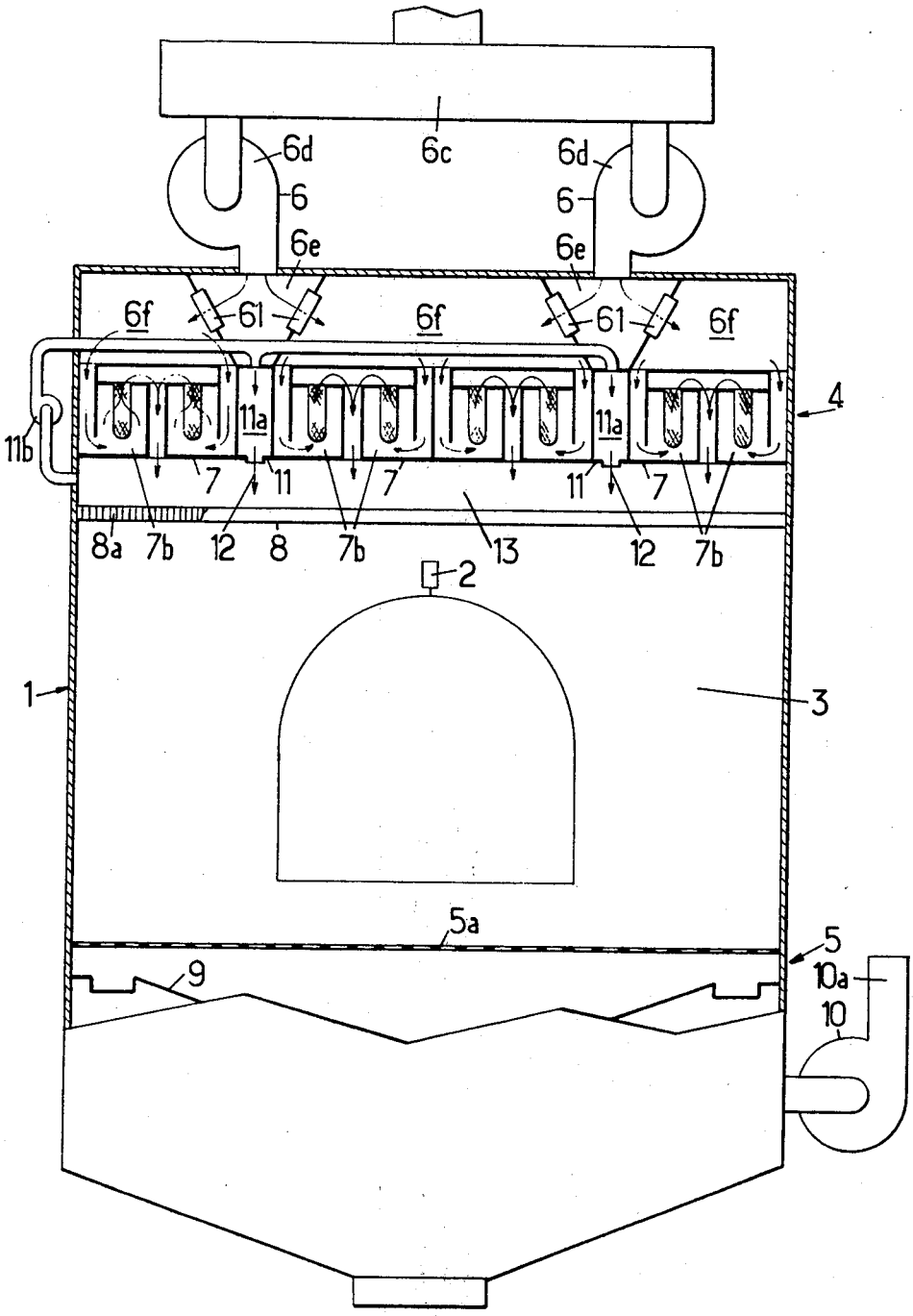
FIG. 2 is a schematical view, in cross section, of an elongated enclosure for painting motor bodies constructed in accordance with another embodiment.

In FIGS. 1 and 2, there is shown an elongated enclosure for painting motor bodies, such an elongated enclosure being called hereafter painting cabin and designated, generally, by the reference 1.

In this painting cabin 1, the motor bodies are conveyed by a conveyor 2 and they are subjected to different painting operations by means, not shown, which may be formed by entirely automatic mechanisms, by semi-automatic mechanisms or by mechanisms requiring employment of an operator.

Such painting cabins 1 are ventilated and, for this purpose, they comprise a treatment space 3 situated between a ceiling 4, through which the supply of new air takes place, and a floor through which the discharge of polluted air takes place.

This ceiling 4 comprises, from upstream to downstream following the path of the air, air supply means 6, filtering means 7 and diffusion means 8.

This floor comprises, from upstream to downstream following the path of the air, separating means 9 for separating the solid and/or liquid particles contained in the discharged polluted air, and means 10 for extracting the polluted air.

Referring to the embodiment illustrated in FIG. 1, the supply means 6 are formed by a duct 6*a* connected to a fan 6*b*.

The filtering means 7 may be formed by a filter provided with one or more layers of a filtering medium 7*a*.

The diffusion means 8 are formed by slat or honeycomb assembly 8*a*.

With reference to the embodiment illustrated in FIG. 2, the supply means 6 are formed by an air inlet duct 6*c*, itself feeding two fans 6*d* which emerge into two parallel ducts 6*e*; these two parallel ducts 6*e* supply three distribution ducts 6*f*.

These supply means 6 may be completed by air-conditioning means 61 for giving the new air a temperature and humidity suitable for the treatment contemplated.

The filtering means 7 are formed by several sleeve filters 7*b* fed by the distribution ducts 6*f* and coming out above the diffusion means 8.

As in the case of the preceding embodiment, these diffusion means 8 may be formed by a slat or honeycomb assembly 8*a*.

As for floor 5, it is formed in most cases, as shown in FIGS. 1 and 2, by a grating 5*a*, below which are located the separating means 9 (formed generally by a scrubber); extraction means 10 are disposed downstream of the separating means 9 and they are advantageously situated laterally in relation to the painting cabin (such extraction means are generally formed by one or more fans 10*a*).

Injection means 11 are then provided and arranged so as to deliver, in the air flow generated by the supply means 6, a plurality of air jets or sheets 12 at a speed greater than that of said flow.

These injection means 11 are arranged and disposed so as to deliver jets or sheets of air in one or more free spaces 13, situated in the ceiling 4 of the painting cabin, between the filtering means 7 and diffusion means 8.

These injection means 11 may be situated just above the diffusion means 8 or, on the contrary, at a distance from these diffusion means 8.

As shown in FIGS. 1 and 2, these injection means 11 may be formed by distribution ducts 11*a* fed with filtered air from the free space 13 by means of one or more fans 11*b*.

Figure 3:
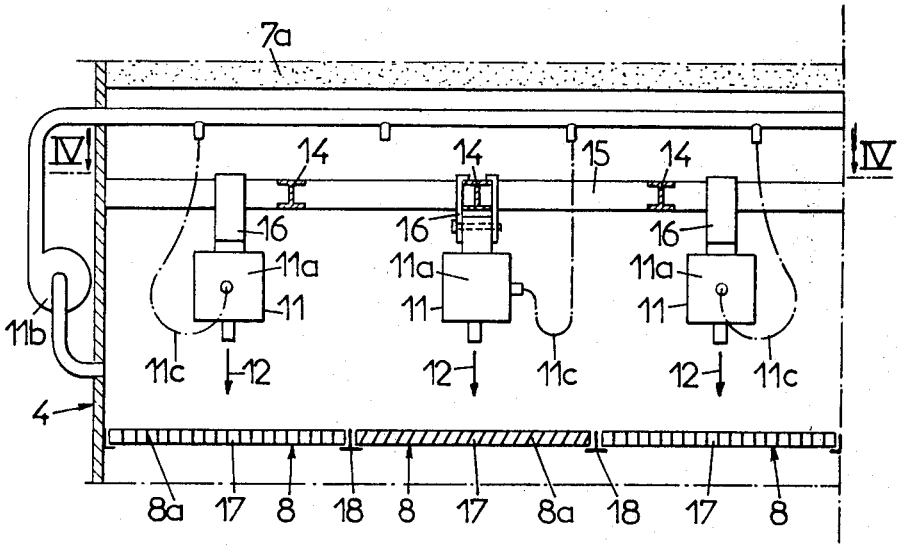
FIG. 3 is a partial view on a larger scale of the enclosure shown in FIG. 1.
Figure 4:
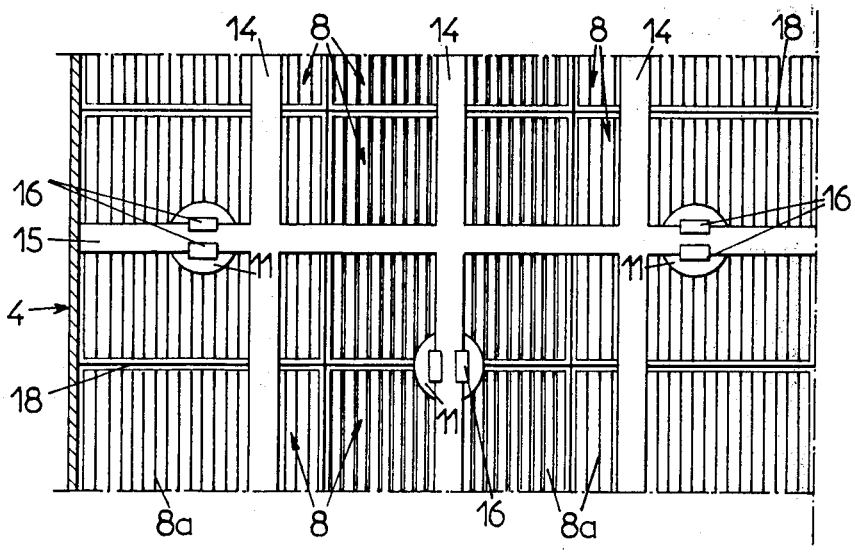
FIG. 4 is a section along IV—IV, FIG. 3.

Advantageously, and as shown in FIGS. 3 and 4, in which the same reference numbers designate the same parts as in FIG. 1, the injection means 11 may occupy varying positions in the free space 13 to modulate the flow in the treatment space 3.

To this end, the free space 13 may comprise a trellis formed by swivelling longitudinal and transverse beams 14 and 15, which support the injection means 11 by means of securing devices 16 capable of being mounted on and removed from any point of the beam trellis 14,15; distribution ducts 11*a* may then comprise a flexible connection 11*c*.

As for the diffusion means 8, they may advantageously be arranged so as to deflect and orientate the air jets or sheets delivered by the injection means 11 towards preferential zones of treatment space 3; these preferential zones may be determined by the man skilled in the art depending on the shape of the bodies to be painted and/or depending on the nature of the paint to be used.

These diffusion means 8 are preferably formed, as shown in FIGS. 3 and 4, in a modular fashion, i.e. by means of removable elements 17 resting on a network of structural sections 18.

These removable elements 17 may have a different construction and/or permeability, which allows the flow in the treatment space 3 to be modulated in direction and/or strength.

Some of these removable elements 17 may moreover be arranged so as to create a convergence of this flow towards a central zone or, on the contrary, a divergence of this flow towards a peripheral zone.

These removable elements 17 may be simply laid on the sections 18 or else pivotably mounted about an axis parallel to some of these sections.

In addition to the advantages already pointed out in the description of the invention which has just been made, it is also possible, from the same painting enclosure, to obtain different modulations in the treatment space by modifying the position of the injection means in the free space and/or by modifying the characteristics and/or the position of the different removable elements forming the diffusion means.

I claim:

1. In a ventilated enclosure for the treatment of workpieces, particularly an elongated enclosure for painting workpieces, comprising a treatment space situated between a ceiling through which the supply of new air takes place and a floor, said ceiling comprising, particularly from upstream to downstream following the path of the air, filtering means and diffusion means, said enclosure being furthermore equipped with injection means, the improvements consisting in that these injection means are located in the ceiling between the filtering means and the diffusion means and arranged and disposed so as to deliver jets or sheets of air in one or more free spaces situated in the ceiling between the filtering means and the diffusion means.

2. Enclosure according to claim 1, wherein the injection means are formed by distribution ducts fed with filtered air from the free space by means of one or more fans.

3. Enclosure according to claim 1 or 2, wherein the injection means are situated just above the diffusion means.

4. Enclosure according to claim 1 or 2, wherein the injection means are situated at a distance from the diffusion means.

5. Enclosure according to any one of claims 1 or 2, wherein the injection means are disposed in the free space so as to be able to occupy varying positions in said space.

6. Enclosure according to any one of claims 1 or 2, wherein the diffusion means are arranged to deflect and orientate the jets or sheets of air delivered by the injection means towards preferential zones of the treatment space.

7. Enclosure according to any one of claims 1 or 2, wherein the diffusion means are formed in a modular fashion by juxtaposition of removable elements.

8. Enclosure according to claim 7, wherein the removable elements present a different constitution.

9. Enclosure according to claim 7, wherein the removable elements present a different permeability.

10. Enclosure according to claim 7, wherein some of the removable elements are arranged to create a convergence of the flow towards a central zone.

11. Enclosure according to claim 7, wherein some of the removable elements are arranged to create a divergence of the flow towards a peripheral zone.

12. Enclosure according to any one of claims 1 or 2, arranged for painting workpieces.

* * * * *